US005331882A

United States Patent [19]

Miller

[11] Patent Number: 5,331,882

[45] Date of Patent: Jul. 26, 1994

[54] CONTROL VALVE SYSTEM WITH FLOAT VALVE

[75] Inventor: Matthew T. Miller, Hudson, Iowa

[73] Assignee: Deere & Company, Moline, Ill.

[21] Appl. No.: 43,059

[22] Filed: Apr. 5, 1993

[51] Int. Cl.[5] ..... F15B 11/08; F15B 13/042

[52] U.S. Cl. ..... 91/461; 91/462; 91/468

[58] Field of Search ..... 91/420, 440, 437, 461, 91/462, 464, 468; 60/494

[56] References Cited

U.S. PATENT DOCUMENTS

| | | | |
|---|---|---|---|
| 3,304,842 | 0/0000 | Shaffer | 91/461 |
| 4,201,052 | 5/1980 | Breeden et al. | 91/461 X |
| 4,206,688 | 6/1980 | Haak et al. | 91/461 X |
| 4,340,087 | 7/1982 | El-Ibiary | 91/420 X |
| 4,611,528 | 9/1986 | Nanda et al. | 91/461 X |
| 5,097,746 | 3/1992 | Asaoka et al. | 91/461 |
| 5,235,809 | 8/1993 | Farrell | 91/461 X |

*Primary Examiner*—Edward K. Look
*Assistant Examiner*—John Ryznic

[57] ABSTRACT

A pilot operated directional control valve communicates fluid between a hydraulic actuator, a pump and a reservoir. A lockout valve is connected between each main control valve work port and a corresponding cylinder port, and operates to reduce fluid leakage therefrom. Each lockout valve includes a pressure responsive poppet valve member which is exposed to fluid pressure in a lockout chamber. A vent control valve is connected between each lockout valve and a corresponding one of the pilot valves. Each vent control valve includes a vent check valve which controls fluid venting from the lockout chamber and a vent piston which is biased to urge the vent check valve to a closed position thereby trapping fluid in the lockout chamber. When both pilot valves are energized, both lockout valves are vented and a float valve moves to a position wherein both cylinder ports are communicated, via the lockout valves and the float valve, with each other and with the reservoir. The float function is obtained without the requirement of additional solenoids or by compromising the available modulation range of the main control valve.

9 Claims, 1 Drawing Sheet

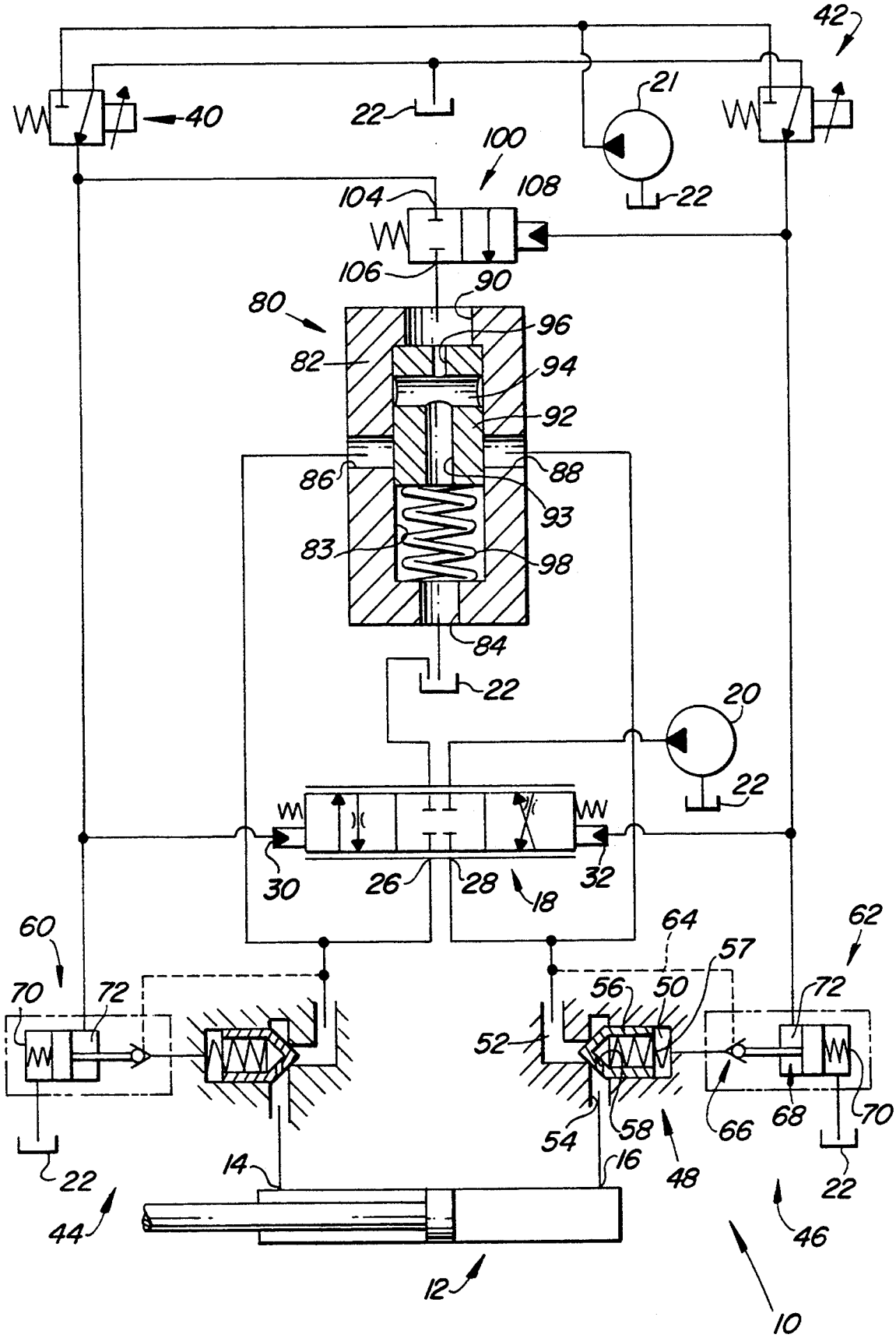
42
40
22
21
22
100
104
108
106
90
80
96
82
94
92
86
88
93
83
98
84
22
20
22
30
26
28
18
32
60
64
57
62
70
72
56
50
72
52
54
58
66
68
70
22
14
16
48
22
44
46
12
10

CONTROL VALVE SYSTEM WITH FLOAT VALVE

BACKGROUND OF THE INVENTION

The present invention relates to a hydraulic control valve system for controlling the operation of a hydraulic cylinder, and more particularly to such a system which has a float function which allows the cylinder to freely move in response to external forces which may act upon it.

It is well known to control an actuator such as a hydraulic cylinder or a hydraulic motor with a pilot operated control valve. The control valve will have a neutral position wherein cylinder motion is prevented and it will have extend and retract positions. It is often desirable to have a float function wherein flow from the actuator ports is allowed to flow, in either direction, from port to port or from port to reservoir. The cylinder or actuator attached to the ports can then move freely due to the external forces acting upon it. Make up oil can be pulled from return to prevent cavitation in the case of a differential area or single acting actuator. Typically, such a float function is achieved by having a float position on the main control valve. In applications where a single pilot valve is used for activation of both the retract and float positions, the available modulation range must be divided between these control modes. Critical metering resolution is then compromised in the retract mode. A float function has also been achieved through the use of an additional third solenoid operated valve which connects both actuator ports to sump when the third solenoid is energized, such as by separate float switch. This solution requires an additional solenoid operated valve. It would be desirable to achieve a float function in a way which does not require a float position on the main control valve and which does not require an additional solenoid.

It is also well known to use cross check valves between such a main control valve and the actuator ports. However, such cross check valves can become unstable in over-running load conditions or due to a drop in supply pressure. Designs which try to overcome this problem by maintaining a restriction in the return flow path during float may compromise performance due to increased pressure drops and undesirable metering characteristics.

Another common method of opening the load check is to vent the pressure cavity behind the check. This creates a force imbalance across the poppet in the direction to open it. Designs of this type, which rely on the spool-to-bore clearance to act as the seal, tend to have higher leakage rates, especially in electrohydraulic valve designs where the minimum clearance may be dictated by hysteresis requirements. It would be desirable to provide a load check valve arrangement which minimizes fluid leakage when the main control valve is in its neutral position and is not affected by a drop in supply or load pressure.

SUMMARY OF THE INVENTION

An object of the present invention is to provide a hydraulic control valve system with a float function which does not compromise metering in the power modes.

Another object of the present invention is to provide a float function which is achieved without an additional float position on the main control valve and without incorporation of an additional solenoid.

Another object of the present invention is to provide a load check function which is independent of supply or load pressure.

Another object of the present invention is to provide such a float function along with low actuator port leakage.

These and other objects are achieved by the present invention wherein a pilot operated, proportional, four-way, three-position main control valve controls fluid communication between an actuator (such as a double or single acting cylinder or a hydraulic motor), a pump and a reservoir. A lockout valve is connected between each main valve work port passage and a corresponding actuator port, and operates to reduce fluid leakage therefrom. Each lockout valve includes a pressure responsive poppet valve member which is exposed to fluid pressure in a lockout chamber. A vent control valve is connected between each lockout valve and a corresponding one of the pilot valves. Each vent control valve includes a vent check valve which controls fluid venting from the lockout chamber and a vent piston which is biased to urge the vent check valve to a closed position thereby trapping fluid in the lockout chamber. When both pilot valves are energized, a logic valve allows movement of the float valve to a position wherein both actuator work ports are communicated, via the lockout valves and the float valve, with each other and with the sump. The pilot valves also communicate pressure to vent release chambers which acts to lift the vent pistons away from the vent check valves and vent the pressure in the lockout chambers to sump via the float valve.

DESCRIPTION OF THE DRAWING

The sole Figure is a hydraulic circuit diagram of main control valve system with a float function according to the present invention.

DETAILED DESCRIPTION

The hydraulic control system 10 controls an actuator 12, such as a double or single acting hydraulic cylinder or a bi-directional hydraulic motor, having a pair of actuator ports 14 and 16. A pilot operated main control valve 18 controls fluid communication between the cylinder 12, a main pump 20 and a reservoir 22. The main control valve 18 is preferably a proportional, pilot operated, spring centered, four-way, three-position valve having a pair of work ports 26, 28, each communicated with a corresponding one of the actuator ports 14,16. A pilot 30 may be pressurized to move the main control valve 18 to a first or extend position and pilot 32 may be pressurized to move the main control valve 18 to a second or retract position.

A first operator controlled, solenoid operated pilot valve 40 controls communication between an auxiliary pump 21, the sump 22, pilot 30 and a lockout valve 44. A second operator controlled, solenoid operated pilot valve 42 controls communication between auxiliary pump 21, the sump 22, pilot 32 and a lockout valve 46.

Each of the lockout valves 44 and 46 is connected between one of the work ports 26, 28 and a corresponding one of the actuator ports 14, 16, and operates to reduce fluid leakage therefrom. Each lockout valve includes a pressure responsive poppet valve 48 exposed to fluid pressure in a lockout chamber 50, a first lockout port 52 communicated with a corresponding one of the work ports, a second lockout port 54 communicated with a corresponding one of the actuator ports, a differential area poppet member 56 biased to a closed position by a spring 57, and an orifice 58 in the poppet member 56 communicating the second lockout port 54 with the lockout chamber 50.

The hydraulic control system 10 also includes a pair of vent control valves 60 and 62. Each vent control valve includes a vent passage 64 which communicates the lockout chamber 50 with the first lockout port 52. A vent check valve 66 controls fluid flow through the vent passage 64. A vent piston 68 engages the vent check valve 66 and a vent spring 70 is biased to urge the vent piston 68 towards the vent check valve 66 and to urge the vent check valve 66 to a closed position thereby preventing fluid flow out of the lockout chamber 50 via the vent passage. Each vent control valve includes a vent release chamber 72 which is communicated with an outlet of a corresponding one of the pilot valves 40 and 42.

The hydraulic control system 10 also includes a pilot operated float valve 80 which has a housing 82 which forms a valve bore 83, a sump port 84 communicated with the reservoir, a first port 86 communicated with work port 26, a second port 88 communicated with work port 28 and a pilot port 90. A valve member 92 is movable in the bore 83 and includes an axial bore 93 which intersects a cross bore 94 and a orifice 96 which communicates cross bore 94 with port 90. The valve member 92 is movable from a first position wherein the first and second ports 86 and 88 are blocked to a second position wherein the first and second ports 86 and 88 are communicated with each other and with the sump port 84 by cross bore 94 and axial bore 93. A spring 98 is biased to urge the valve member 92 to its first position. The valve member 92 is movable to its second position in response to pressurization of the pilot port 90.

The hydraulic control system 10 also includes a logic valve 100 which operates to pressurize the pilot port 90 only when both the pilot valves 40 and 42 are simultaneously operated. The logic valve 100 includes an inlet 104 communicated with an outlet of one of the pilot valves 40 and 42, an outlet port 106 communicated with the pilot port 90 of the float valve 80 and a pilot port 108 communicated with an outlet of the other of the pilot valves 40 and 42.

The logic valve 100 is movable from a first position wherein inlet 104 and outlet 106 are blocked to a second position wherein the inlet 104 is communicated with the outlet 106. A spring 112 is biased to urge the logic valve 100 to its first position and the logic valve 100 is movable to its second position in response to pressurization of its pilot port 108.

MODE OF OPERATION

For each of pilot valves 40 and 42, when its solenoid is off, the corresponding pilot is communicated with the sump 22, and when its solenoid is on, the corresponding pilot is communicated with the pump 21. As a result, when pilot valve 40 is energized, pilot 30 is pressurized and main control valve 18 connects the pump 20 to work port 28 and to actuator port 16 and connects sump 22 to work port 26 and to actuator port 14 to extend the cylinder 12. Similarly, when pilot valve 42 is energized, pilot 32 is pressurized and main control valve 18 connects the pump 20 to work port 26 and to actuator port 14 and connects sump 22 to work port 28 to actuator port 16 to retract the cylinder 12. The independent pilot valves 40 and 42 provide a control pressure acting on the ends of the main control valve which is proportional to the electrical input. The main control valve 18 then moves to a position which results in a force balance between the pressure forces and the centering spring. Directional and rate control of flow is thus achieved by movement of the main control valve 18 in the manner described.

In extend and retract power modes only one pilot control valve is activated and the control pressure acts to move the main valve 18 to meter oil from pump 20 to one of the work ports 26, 28. This same pressure is used to vent the corresponding lockout valve 46 or 44 on the return side of the actuator 12 and allow return flow from the actuator 12 to be metered across the main control valve 18 to sump or return. Using the independent control pressure from pump 21 to vent the return side lockout valve eliminates chatter or instability problems that can arise with conventional cross checks or other lockout designs that rely on main pump supply or load pressure to open both lockouts.

When both pilot valves 40, 42 are energized, pilots 30 and 32 are both pressurized and there is no net motion of main control valve 18. Also, when both pilot valves are energized, the logic valve 100 moves to its second position which pressurizes port 90 and moves float valve 80 to its second position wherein both actuator ports 14 and 16 are communicated, via the lockout valves 44 and 46, with each other and with sump 22 via the float valve 80. As a result, a float function is provided independent of the main control valve 18. In addition, the float function is obtained without the requirement of additional solenoids and without comprimising the available modulation range of the additional control valve.

Pilot valves 40 and 42 also communicate pump pressure to the vent release chambers 72 of the vent control valves 60 and 62. This pressure acts to lift the vent pistons 68 away from the vent check valves 66, which vents the pressure in the lockout chambers 50 to sump 22 via float valve 80. As a result, only a small pressure differential is needed across the poppet members 56 to overcome the low bias force of the springs 57. This allows free flow from actuator ports 14 and 16 to each other or to sump 22, in either direction via float valve 80.

When both pilot valves 40, 42 are de-energized, pilots 30 and 32 are both unpressurized and the main control valve 18 will be in its neutral position. Also, when both pilot valves 40, 42 are de-energized, both the vent release chambers 72 of the vent control valves 60 and 62 are unpressurized and the vent check valves 66 are closed by the vent pistons 68 under the force of springs 70. Thus, when external forces act on the cylinder 12 fluid leakage past the load check valve popper members 56 via orifice 58 is blocked by the closed vent check valves 66.

Flow from sump 22 to one of the actuator ports 14 or 16 occurs when the forces on the cylinder 12 causes the pressure in the actuator port to drop below sump pressure. The corresponding vent check valve 66 will then reseat and the net hydraulic force acting on the poppet member 56 will then open the corresponding lockout valve 44 or 46. This allows fluid to flow from sump 22 to the actuator port 14 or 16 to avoid any further drop in actuator port pressure or cavitation.

This design results in a system which inherently provides for pressure relief of the actuator ports 14 and 16 in the design of the lockout valves 44 and 46. This allows for relief of actuator port pressure build up above system pressure that may be caused by thermal expansion or pressure intensification, as may occur in a design with zero leakage lockout capability. This relief action occurs whenever the actuator port pressure acting on the seated area of the vent check valve 66 results in a force greater than the pre-load force of the lockout piston spring 70. The vent check valve 66 then lifts from its seat and bleeds an amount of oil required to relieve the work port pressure before reseating.

In comparison to a design in which lockout leakage is dependent on main spool-to-bore clearance, the present design achieves low actuator port leakage along with lower hysteresis due to the greater permissible main spool-to-bore clearances.

Improved flow metering results since the entire control pressure range from the pilot valves 40 and 42 can be used for extend or retract modes. The float function (which is not typically used often) is achieved without compromising metering in the extend or retract modes.

An inlet load check valve is not required since only the return side actuator port lockout valve is vented in the power modes. The lockout valve on the same side as the actuator port to which oil is being supplied by main control valve 18 is held open by the flow induced pressure differential across the poppet member 56. Therefore, if a drop in the pressure supplied by pump 20 results in the work port pressure being lower than actuator port pressure, the lockout valve will close due to the change in sign of the pressure differential across the poppet member 56 and prevent oil flow from the actuator port.

The lockout valves can be removed if the application does not require low actuator port leakage.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

I claim:

1. A hydraulic control system for controlling a hydraulic actuator having a pair of actuator ports, the system having a pump, a reservoir, a pilot operated main control valve for controlling fluid communication between the actuator, the pump and the reservoir, the main control valve having a pair of work ports communicated with the actuator ports, and first and second pilot valves for controlling operation of the main control valve, one of the pilot valves being operable to move the main control valve from a neutral position holding the actuator stationary to a first position causing the actuator to move in one direction, and the other pilot valve being operable to move the main control valve from the neutral position to a second position causing the actuator to move in a second direction, characterized by:

a float valve responsive to both pilot valves and communicated with both actuator ports, the float valve being separate from the main control valve and being operable to communicate both actuator ports to sump in response to actuation of both pilot valves.

2. The invention of claim 1, wherein the float valve comprises:

a housing having a sump port communicated with the reservoir, a first port communicated with one of the actuator ports, a second port communicated with the other of the actuator ports, a pilot port, a float valve member having a first position wherein the first and second ports are blocked, and having a second position wherein the first and second ports are communicated with the sump port and a resilient member biased to urge the valve member to its first position, the valve member being movable to its second position in response to pressurization of its pilot port; and logic valve means for pressurizing the pilot port when both the first and second pilot valves are operated.

3. The invention of claim 2, wherein the logic valve means comprises:

an inlet communicated with an outlet of one of the first and second pilot valves, an outlet port communicated with the pilot port of the float valve and a pilot port communicated with an outlet of the other of the first and second pilot valves, the logic valve means being movable to a first position wherein the inlet and the outlet are blocked and to a second position wherein the inlet is communicated with the outlet; and a resilient member biased to urge the logic valve means to its first position, the logic valve means being movable to its second position in response to pressurization of its pilot port.

4. The invention of claim 1, further comprising:

a pair of lockout valves, each lockout valve being connected between one of the work ports and a corresponding one of the actuator ports and operating to reduce fluid leakage therefrom.

5. The invention of claim 4, wherein each lockout valve comprises:

a pressure responsive poppet valve having a lockout chamber, a first lockout port communicated with a corresponding one of the main valve work ports, a second lockout port communicated with a corresponding one of the actuator ports, an orifice communicating the second lockout port with the lockout chamber and a poppet member normally biased by a spring to a closed position to prevent fluid flow from the second lockout port to the first lockout port;

a vent passage communicating the lockout chamber with the first lockout port;

a vent check valve for controlling fluid flow through the vent passage; and a vent piston engagable with the vent check valve;

a vent spring engaging the vent piston and biased to urge the vent piston towards the vent check valve and to urge the vent check valve to a closed position thereby preventing fluid flow out of the vent chamber via the vent passage; and a vent release chamber communicated with an outlet of a corresponding one of the first and second pilot valves, in response to pressurization of the vent release chamber, the vent piston being movable away from the vent check valve so that the vent check valve opens to release the fluid pressure in the lockout chamber so that the poppet member can move to permit fluid flow from the second lockout port to the first lockout port.

6. The invention of claim 5, wherein:

each poppet member has a differential pressure responsive area.

7. A hydraulic control system for controlling an actuator having a pair of actuator ports, the system having a pump, a reservoir, a pilot operated main control valve for controlling fluid communication between the actuator, the pump and the reservoir, the main control valve having a pair of work ports communicated with the actuator ports, first and second pilot valves for controlling operation of the main control valve, one of the pilot valves being operable to move the main control valve from a neutral position holding the actuator stationary to a first position causing the actuator to move in a first direction, and the other pilot valve being operable to move the main control valve from the neutral position to a second position causing the actuator to move in a second direction, characterized by:

a lockout valve comprising a pressure responsive poppet valve member movable in response to fluid pressure in a lockout chamber to control communication between a work port of the main control valve and a corresponding one of the actuator ports, a first lockout port communicated with a corresponding one of the main valve work ports, a second lockout port communicated with a corresponding one actuator ports, an orifice communicating the second lockout port with the lockout chamber;

a vent passage communicating the lockout chamber with the main control valve;

a vent check valve for controlling fluid flow through the vent passage;

resilient means for urging the vent check valve to a closed position thereby preventing fluid flow out of the backout chamber via the vent passage; and pressure responsive means communicated with one of the first and second pilot valves for opening the vent check valve when the one pilot valve is pressurized.

8. The invention of claim 7, wherein the pressure responsive means comprises:

a vent piston engagable with the vent check valve and the resilient means; and a vent release chamber communicated with an outlet of a corresponding one of the first and second pilot valves, the vent piston being movable away from the vent check valve in response to pressurization of the vent release chamber, so that the vent check valve opens to release the fluid pressure in the lockout chamber so that the poppet member can move to permit fluid flow from the second lockout port to the first lockout port.

9. A hydraulic control system for controlling a hydraulic actuator having a pair of actuator ports, the system having a pump, a reservoir, a pilot operated main control valve for controlling fluid communication between the cylinder, the pump and the reservoir, the main control valve having a pair of work ports communicated with the actuator ports, and first and second pilot valves for controlling operation of the main control valve, one of the pilot valves being operable to move the main control valve from a neutral position holding the actuator stationary to a first position causing the actuator to move in a first direction, and the other pilot valve being operable to move the main control valve from the neutral position to a second position causing the actuator to move in a second direction, characterized by:

a float valve communicated with both pilot valves and with the actuator ports, the float valve being operable to communicate both actuator ports to sump in response to actuation of both pilot valves; and a pair of lockout valves, each lockout valve being connected between one of the work ports and a corresponding one of the actuator ports and operating to reduce fluid leakage therefrom.

* * * * *

UNITED STATES PATENT AND TRADEMARK OFFICE

CERTIFICATE OF CORRECTION

PATENT NO. : 5,331,882

DATED : 26 July 1994

INVENTOR(S) : Matthew Thomas Miller

It is certified that error appears in the above-indentified patent and that said Letters Patent is hereby corrected as shown below:

In Col. 7, line 35, delete "backout" and insert -- lockout --.

Signed and Sealed this

Twentieth Day of December, 1994

*Attest:*

Bruce Lehman

BRUCE LEHMAN

*Attesting Officer*

*Commissioner of Patents and Trademarks*